US005848686A

United States Patent [19]

Dean

[11] Patent Number: 5,848,686

[45] Date of Patent: Dec. 15, 1998

[54] COLLATING STRUCTURE

[76] Inventor: Carl Andy Dean, 9830 N. MacArthur Blvd., #1807, Irving, Tex. 75063

[21] Appl. No.: 960,522

[22] Filed: Oct. 31, 1997

[51] Int. Cl.[6] ..... B65D 85/00

[52] U.S. Cl. ..... 206/215; 206/449; 229/120.32

[58] Field of Search ..... 206/215, 216, 206/223, 224, 449, 45.24, 45.25, 736, 737, 741, 758, 774, 804, 425; 229/120.01, 120.32, 120.37

[56] References Cited

U.S. PATENT DOCUMENTS

| | | | |
|---|---|---|---|
| 727,211 | 5/1903 | Schweer | 206/215 |
| 1,140,061 | 5/1915 | Pike | 206/215 |
| 1,339,908 | 5/1920 | Thorpe | 206/215 |
| 1,592,922 | 7/1926 | Burnham . | |
| 1,656,379 | 1/1928 | Lee, Jr. . | |
| 1,769,719 | 7/1930 | Smith | 206/215 |
| 1,782,915 | 11/1930 | Weidner . | |
| 1,798,406 | 3/1931 | Dunn . | |
| 1,871,617 | 8/1932 | King . | |
| 1,917,349 | 7/1933 | Wilmarth . | |
| 2,019,802 | 11/1935 | Sproull | 206/215 |
| 2,047,033 | 7/1936 | Ringler . | |
| 2,207,917 | 7/1940 | Fleisher . | |
| 2,425,895 | 8/1947 | Overly . | |
| 2,457,812 | 1/1949 | Epps . | |
| 2,476,102 | 7/1949 | Lobell . | |
| 2,478,635 | 8/1949 | Overly . | |
| 2,551,390 | 5/1951 | Overly . | |
| 3,055,494 | 9/1962 | Hepp . | |
| 3,182,792 | 5/1965 | Viltrakis . | |
| 3,963,167 | 6/1976 | Newgaard, II . | |
| 3,973,674 | 8/1976 | Postlethwaite . | |
| 5,282,533 | 2/1994 | Holzwarth et al. | 206/45.24 |
| 5,485,916 | 1/1996 | Dean . | |

*Primary Examiner*—Paul T. Sewell
*Assistant Examiner*—Luan K. Bui
*Attorney, Agent, or Firm*—Jenkens & Gilchrist, P.C.

[57] ABSTRACT

An improved collating structure capable of receiving, storing, displaying, withdrawing and reinserting a multiplicity of at least two different functionally-related and/or traditionally-associated items is disclosed. An insert which is removably disposed with a main body portion defines a first compartment within the collating structure. A tray including a recessed area or, alternatively, a pocket, defines a second compartment within the collating structure. The tray (or pocket) is capable of sliding between a first position hidden underneath and within the insert and a second position extending outwardly and above the insert to provide visual and actual access to the second compartment. The separate compartments are capable of containing functionally-related and/or traditionally-associated items, such as greeting cards and envelopes or trading cards and card mounts, in a manner which provides quick and easy access to such items and limits the overall size of the collating structure.

19 Claims, 5 Drawing Sheets

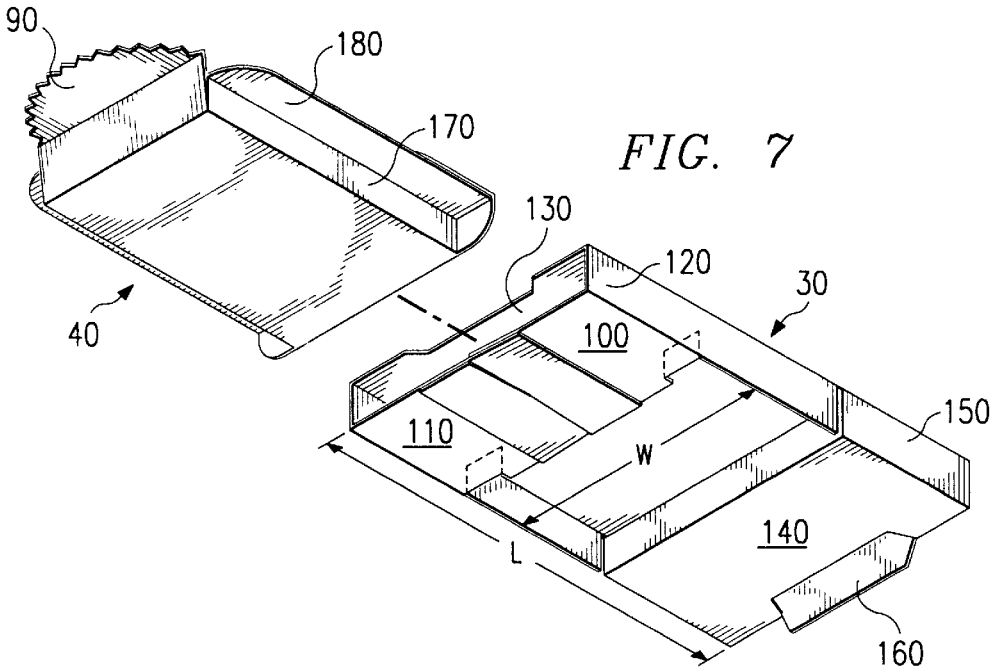
FIG. 7
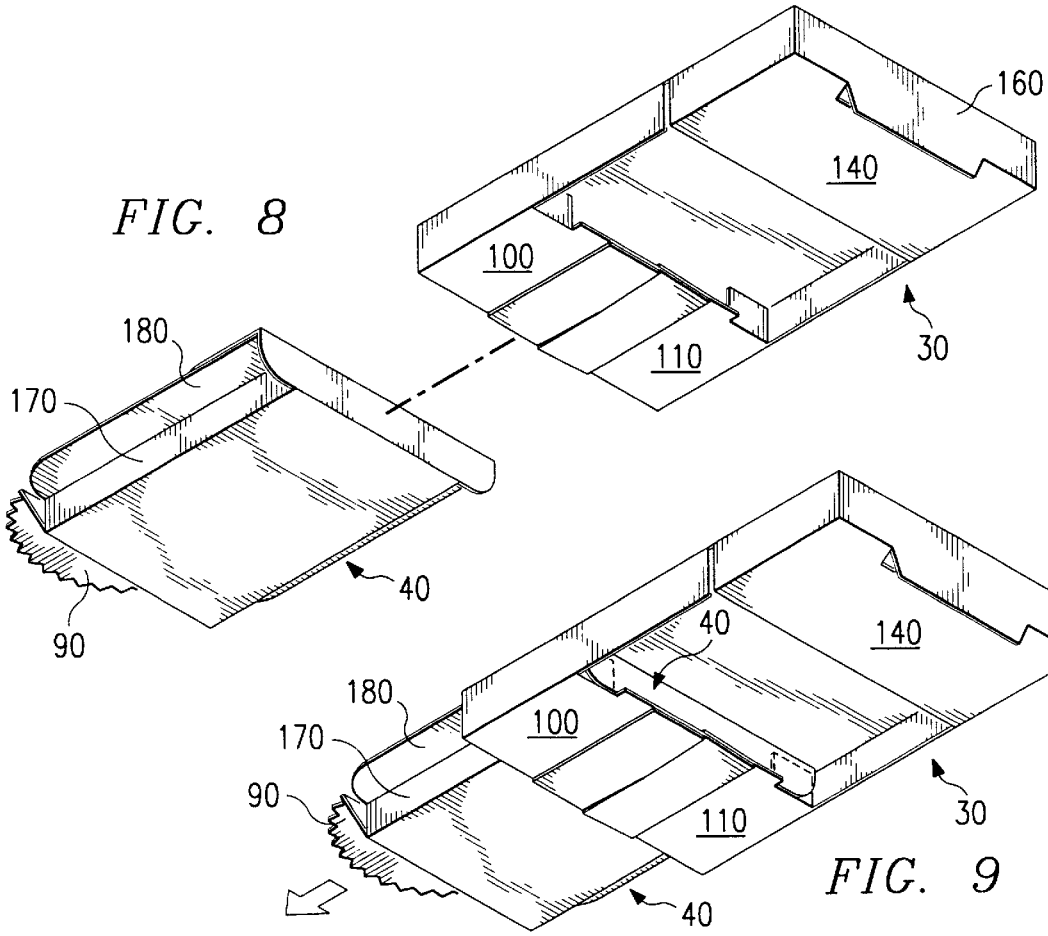
FIG. 8
FIG. 9

FIG. 10
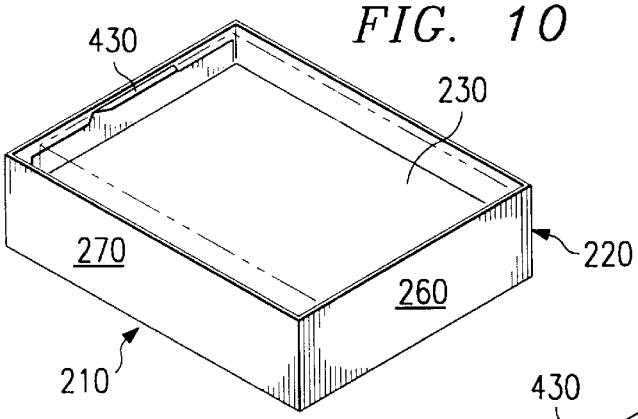
FIG. 11
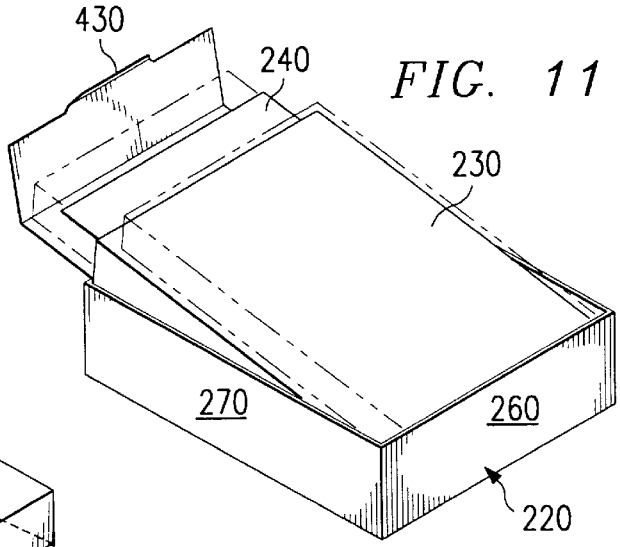
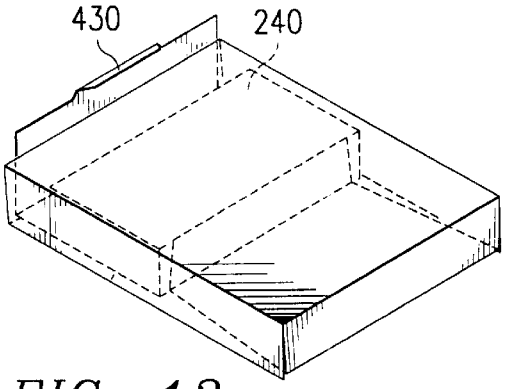
FIG. 12
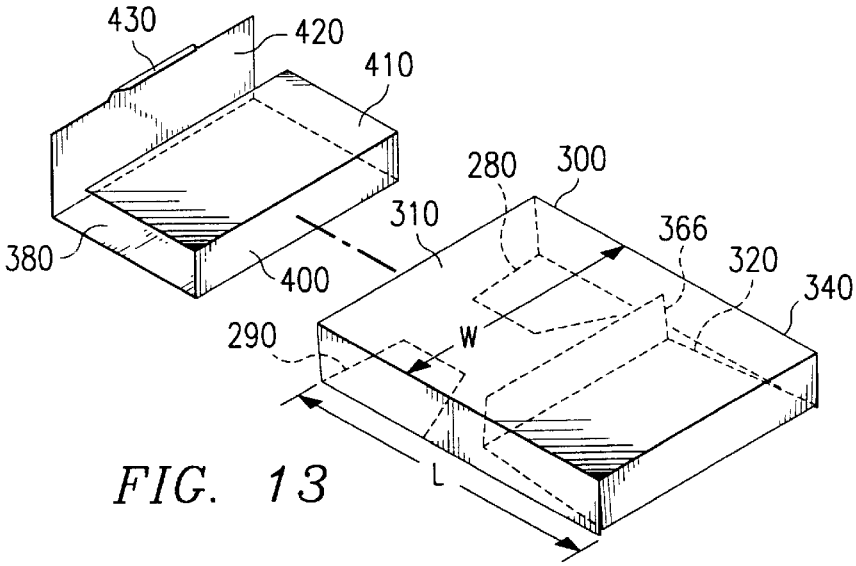
FIG. 13

COLLATING STRUCTURE

TECHNICAL FIELD

This invention relates to improvements in box and package technology and, more specifically, to an improved structure to receive, collate, store and dispense a multiplicity of functionally-related and/or traditionally-associated items, such as stationary and envelopes.

BACKGROUND OF THE INVENTION

Many functionally-related and/or traditionally-associated items, such as stationary and envelopes or baseball cards and card holders, are packaged together for shipment, display and/or use. Such association of items is desired to both decrease the cost and complexity of shipping and displaying items as well as to increase the convenience of using such items.

Items such as these historically have been packaged together for shipment by the manufacturer and subsequently unpacked and displayed by the retailer and/or used by a consumer in a different package or container. This is due to the fact that shipping packages do not function well as display and/or use packages and vice versa. Unfortunately, this results in significant waste of numerous boxes and packages, a consequent trash disposal problem. Since most such packages are constructed of cardboard or other paper-based products, the waste of a precious natural resource, namely trees, further highlights the significant disadvantage associated with this practice.

Accordingly, there have been efforts to design packages and containers suitable for use both as a shipping package and as a display and/or use package. However, difficulties have been encountered with the use of such prior art devices. For example, packages have been designed in which a stack of stationary has been boxed with a stack of envelopes. In such packages, the stack of stationary rests on top of the stack of envelopes, requiring one to reach under and/or remove all of the stationary to extract a single envelope for use. Use of this design of prior art package often results in the contents of the box being spilled or the various components being mixed together, thereby frustrating the user. Additional prior art packages have been designed in which the stationary and envelopes are presented stacked and on their edges. While this prior art design allows for the extraction of a single card and envelope without the need to reach under or remove the stationary, the design suffers a significant disadvantage in that the faces of the cards are not presented to the user. Without a view of the faces of the cards, a potential buyer cannot appreciate of the aesthetics of the cards and selection of the cards for use is further complicated.

Recently, a new design of package has been developed which allows functionally-related and/or traditionally-associated items to be packaged together both for shipment, display and/or use and which avoids the disadvantages outlined above. This new design is a collating structure which receives, holds and displays such items and is further described in U.S. Pat. No. 5,485,916, issued Jan. 23, 1996 to the present inventor (the "'916 Patent").

Although the improved collating structure described in the '916 Patent avoids the disadvantages associated with prior art packages and outlined above, further improvements are needed. For example, the improved collating structure of the '916 Patent uses slightly offset inner compartments for the stationary and associated envelopes, requiring the overall size of the package to be slightly increased. Therefore, one significant improvement would be embodied by a collating structure which could avoid the traditional disadvantages outlined herein and reduce the overall size of the package.

SUMMARY OF THE INVENTION

The improved collating structure of the present invention overcomes the foregoing and other problems associated with the prior art by providing a collating structure having a main body, an insert within the main body and a slidable tray disposed within the insert. This design allows for functionally-related and/or traditionally-associated items to be separately contained within it without the need to offset the inner compartments, thus reducing the overall size of the structure.

In one embodiment of the improved collating structure of the present invention, the main body portion receives an insert. The insert is substantially hollow and is further comprised of a tray which slides into and disappears within the insert. A tab on the tray allows a user to slide the tray out from inside the insert, revealing an inner compartment capable of containing items. When in place within the main body, the insert occupies only a portion of the main body, thus defining a second compartment for the containment of items. An optional lid is provided to completely cover the top of the main body.

In use, functionally-related and/or traditionally-associated items, such as greeting cards and envelopes, are contained within the improved collating structure as follows: the envelopes are placed within the sliding tray of the insert. The tray is slid into the insert and effectively disappears from view. The insert is subsequently placed within the main body portion. The cards are placed within the compartment defined by the space left unoccupied by the insert when the insert is disposed within the main body portion. Accordingly, when viewed from the top, the package displays the faces of the cards so that their aesthetics can be appreciated and selection is quick and easy. A slight tug on the tab of the tray slides the tray out from within the insert, revealing the envelopes associated with the stationary. When an envelope is selected and removed from the tray, the tray is slid back into its hidden position within the insert and the packages can be closed.

In a second embodiment of the improved collating structure of the present invention, the collating structure includes a pocket versus a tray. The pocket is larger than the tray and therefore suited for use with larger items to be contained therein.

As demonstrated above, the improved collating structure of the present invention avoids the disadvantages associated with prior art structures while providing a compact and substantially smaller overall package size, thus reducing construction shipping and storage costs.

BRIEF DESCRIPTION OF THE DRAWINGS

For a more complete understanding of the present invention and the advantages thereof, reference is now made to the following description taken in conjunction with the accompanying drawings in which:

FIG. 7 is a bottom perspective view of the main body portion of the improved collating structure of the present invention;

FIG. 8 is another bottom perspective view of the main body portion and tray of the improved structure of the present invention;

FIG. 9 is a bottom perspective view of the main body portion and tray of the improved collating structure, illustrating the sliding of the tray within the main body portion;

FIG. 10 is a perspective view of a second embodiment of the improved collating structure;

FIG. 11 is a perspective view of the a second embodiment of the improved collating structure of the present invention, illustrating movement of the insert;

FIG. 12 is a perspective view of the insert of a second embodiment of the improved collating structure which has been removed from the main body;

FIG. 13 is a perspective view of the insert of a second embodiment of the improved collating structure removed from the main body, illustrating the removal of the inner pocket of insert;

DETAILED DESCRIPTION OF THE DRAWINGS

Figure 1:
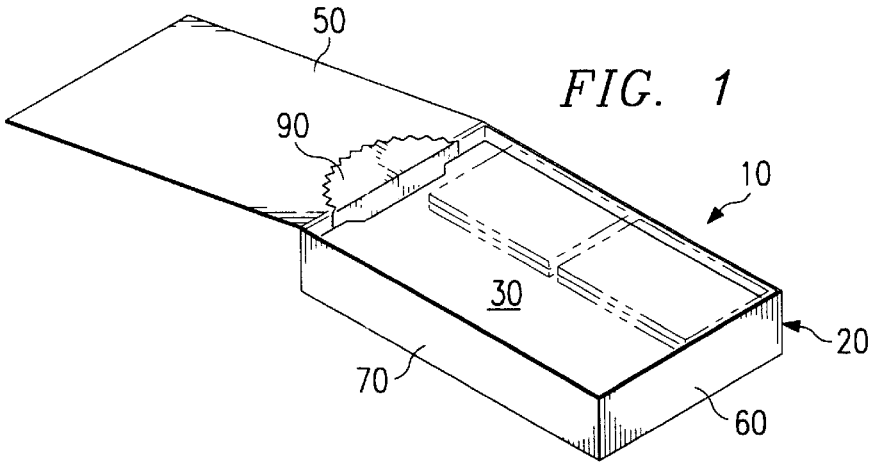
FIG. 1 is a perspective view of one embodiment of the improved collating structure of the present invention.
Figure 2:
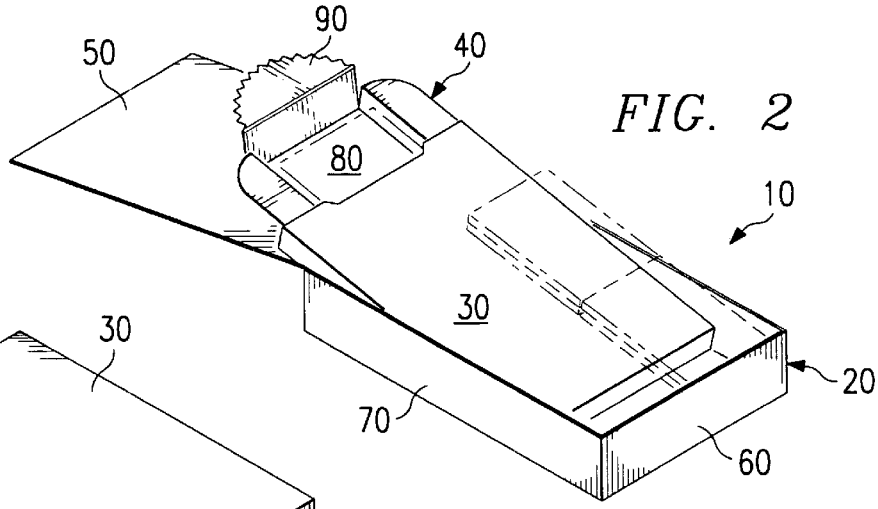
FIG. 2 is a perspective view of one embodiment of the improved collating structure of the present invention, illustrating movement of the insert.

Referring to FIGS. 1 and 2, there are shown perspective views of an embodiment of the improved collating structure of the present invention. The improved collating structure 10 comprises a main body portion 20, an insert 30 removably disposed within the main body portion 20, a tray 40 slidable between a first position (FIG. 1) and a second position (FIG. 2), the main body portion 20 including a foldable top 50. The main body portion 20 is substantially a hollow box and receives the insert 30 within it. The insert 30 is shaped and sized to fit within the main body portion 20 and form a false bottom therein. The space left unoccupied by the insert 30 when it is disposed within the main body portion 20 (i.e., the space above the false bottom and below the lid 50) defines a first compartment capable of receiving, holding and displaying items. Such items can be enclosed by folding over the lid 50 of the main body portion 20 and, optionally, securing the lid 50 via, for example, a tab and receiving slot arrangement (not shown).

The main body portion 20 comprises a generally square or rectangular box, having a flat, substantially horizontal base, a pair of vertical end walls 60, a pair of vertical side walls 70, and a lid 50. The lid 50 of the main body portion 20 is foldable to completely cover the top of the main body portion 20. A tab and receiving slot (not shown) or other device to secure the lid 50 is optional. Although a tab and receiving arrangement has been described, it is noted that the lid 50 of the main body portion 20 can be secured using any suitable means.

Figure 4:
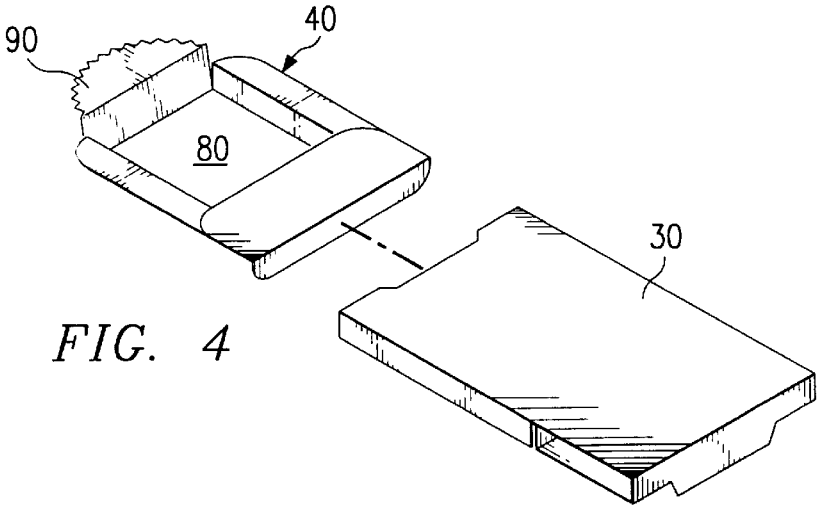
FIG. 4 is a perspective view of the insert removed from the main body, illustrating the removal of the inner tray of the insert.

The tray 40 includes a recessed portion 80 within it which defines a second compartment. The tray 40 further includes a tab 90 towards one of its ends. The tab 90 facilitates sliding of the tray 40 between a first position (disposed entirely within the insert 30—FIG. 1), a second position (extending out and away from the insert—FIG. 2) and a third position (separated from the insert 30—FIG. 4). The recessed portion 80 within the tray 40 does not extend across the entire width of the tray 40 and is capable of receiving and containing various items. When the tray 40 is in the first position (FIG. 1), it is substantially hidden within the hollow insert 30. Accordingly, items contained within the tray 40 are not visible when the open collating structure 10 is viewed. When the contents of the recessed portion 80 of the tray 40 are desired, the tab 90 is pulled and the tray 40 slides out of the insert 30, extending out and above the main body portion 20 of the collating structure 10. In this second position (FIG. 2), the contents of the tray 40 are easily viewed and extracted. In the third position (FIG. 4), the tray 40 is completely separated from the insert 30. In this position, the recessed portion 80 is most easily loaded with items to be contained. When the contents of the recessed portion 80 of the tray 40 are loaded, the tray 40 is inserted into the hollow portion of the insert 30 and the tab 90 is gently pushed back towards the main body portion 30, sliding the tray 40 into the insert 30 and out of sight. Importantly, this feature of the improved collating structure allows for the separate receipt, containment and access to the contents of the tray 40 without requiring the overall size of the collating structure to be larger than the largest separate item contained within it, avoiding the need for offset containers and/or the need to reach under and/or remove one item to view and access the other(s).

For purposes of this application, the terms "items" and "contents" are used to refer to any items capable of being contained within the improved collating structure 10 and its components. Preferably, such items or contents are functionally-related or traditionally-associated items, such as stationary and envelopes, greeting cards and envelopes, stationary and postage stamps, trading or collection cards and display mounts, and the like.

Figure 3:
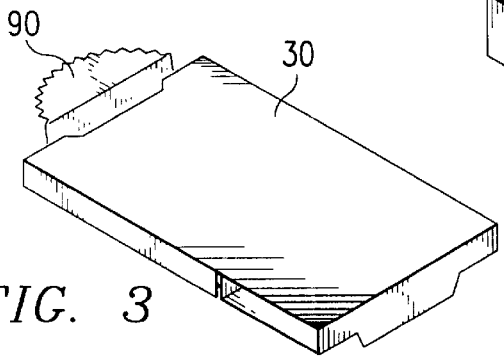
FIG. 3 is a perspective view of the insert of one embodiment of the improved collating structure which has been removed from the main body.
Figure 6:
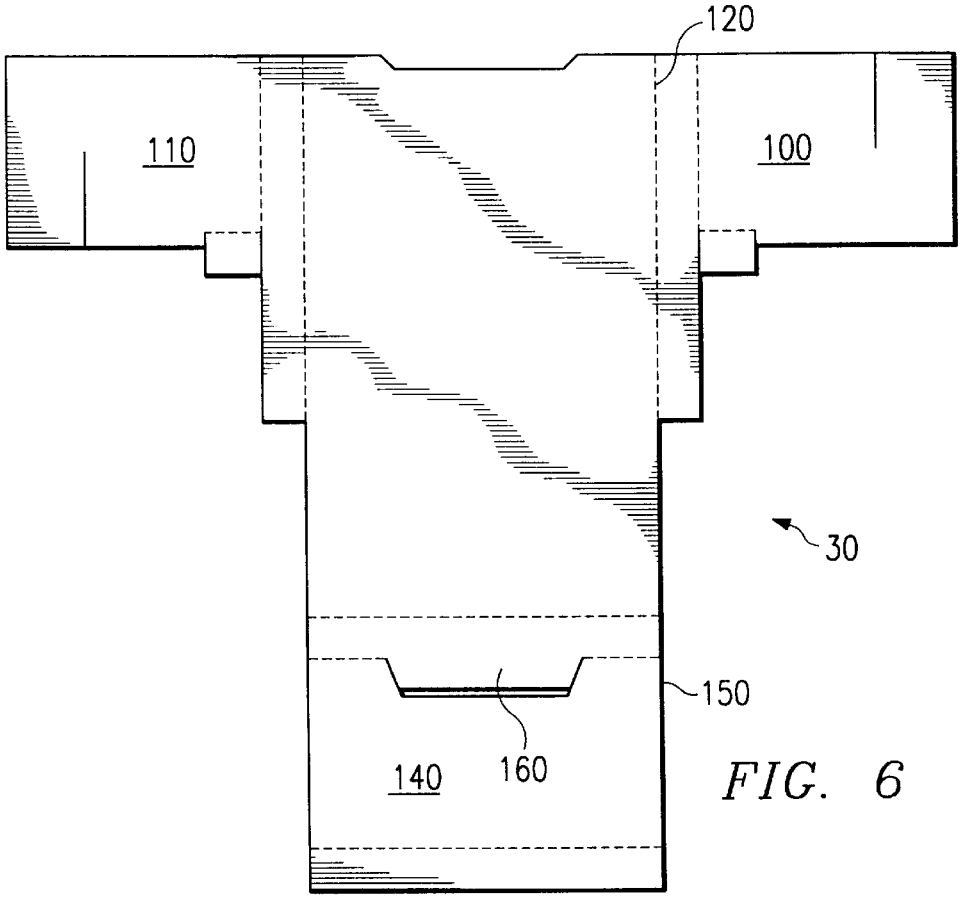
FIG. 6 is a top view of the unfolded insert of the improved collating structure of the present invention.
Figure 14:
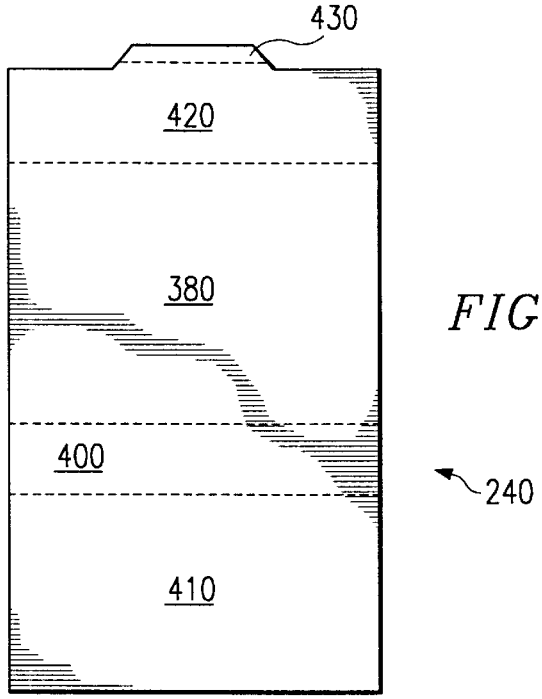
FIG. 14 is a top view of the unfolded inner pocket of the insert of a second embodiment of the improved collating structure of the present invention.

Now referring to FIG. 3, wherein like elements are identified with like reference numerals, there is shown the insert 30 of the collating structure 10 separated from the main body portion 20. The tab 90 is visible but the tray 40 itself is disposed within the hollow portion of the insert 30 (ie., in the first position) and therefore is not visible in this FIGURE. As illustrated in FIGS. 7–9, in which like elements are identified with like reference numerals, there are shown bottom perspective views of the insert 30 and tray 40 of the collating structure 10. The insert 30 includes folding flaps 100 and 110 which fold across the width W of the underside of the insert 30 towards a first end 120. The folding flaps 100 and 110 overlap and are slotted so that they may be removably secured to each other. When folded and secured, the folding flaps 100 and 110 define a receiving guide 130 for the tray 40. A large end flap 140 located at a second end 150 of the insert 30 folds across a portion of the length L of the insert 30. The end flap 140 provides support for the upper portion of the insert 30. A tab 160 located underneath the end flap 140 contacts the bottom of the main body portion 20 (not shown) when the insert 30 is placed within the main body portion 20 and supports the end flap 140. In FIG. 6, a bottom view of an unfolded insert 30 is illustrated.

Figure 5:
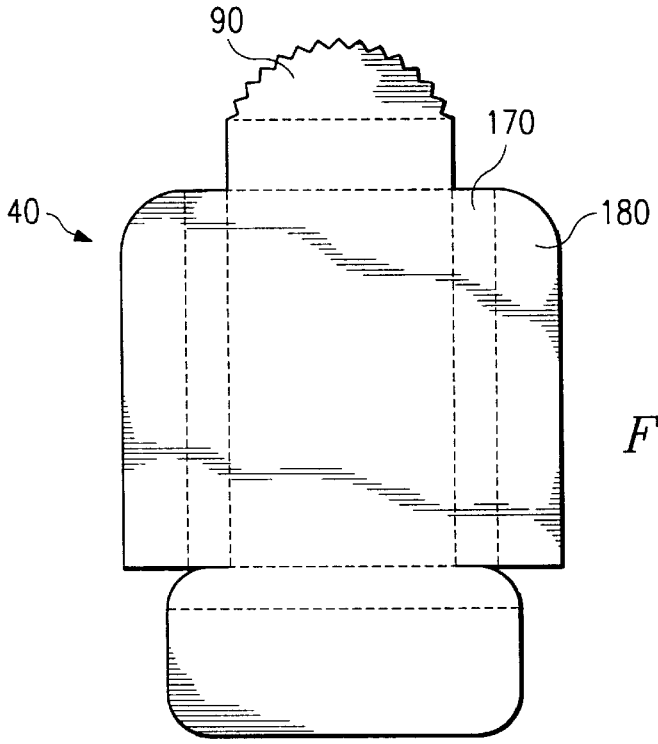
FIG. 5 is a top view of the unfolded inner tray of the insert of the improved collating structure of the resent invention.

Referring again to FIGS. 7–9, the tray 40 is folded along it sides to define the recessed portion 80 (not shown). The exterior sides 170 of the recessed portion 80 (not shown) terminate at their upper ends to form sliding flaps 180. When the tray 40 is inserted into the insert 30, the exterior sides 170 and the elongated sliding flaps 180 contact the sides of the receiving guide 130 of the insert 30 and guide the tray 40 into place (the first position) within the insert 30. The tab 90 of the tray 40 facilitates sliding the tray 40 into and within the insert 30. FIG. 5 illustrates the tray 40 as viewed from the bottom and in an unfolded state.

In use, functionally-related and/or traditionally-associated items, such as greeting cards and envelopes, are contained for shipment, display and/or use using the improved collating structure 10 of the present invention as follows: the tray 40 is removed from within the insert 30 by pulling on the tab 90. The envelopes are placed within the recessed portion 80 of the tray 40 and the tray 40 is slid back into and underneath the insert 30. The greeting cards are then placed into the area defined by top of the insert 30 and below the lid 50 of the main body portion 20. The lid 50 is then folded over the top portion of the main body portion 20 and optionally secured. The greeting cards and envelopes are now contained separately within the collating structure 10. When a greeting card is desired, the lid 50 is opened, and a greeting card is selected. Since the faces of the greeting cards are viewable upon opening the lid 50 of the main body portion 20, there is no need to remove cards or reach underneath anything to make a selection, as required by some prior art containers.

Next, an envelope is extracted by pulling on the tab 90 of the tray 40 and sliding the tray 40 from its hidden position underneath and within the insert 30. As the tray 40 slides outward, the insert 30 is not as fully supported as when the tray 40 is in the first position, causing the tray 40 to be tilted upwards at its distal end as it extends outward from the insert 30. This tilting feature facilitates viewing, selecting and extracting the envelopes in that as the tray 40 tilts upwards on its end, gravity naturally separates and displays in a staggered fashion the envelopes (or other items) contained therein, increasing visibility and enhancing selection and extraction of the items.

Once an envelope is selected and extracted, the tray 40 is slid back into its second position underneath and within the insert 30 by pushing on the tab 90 of the tray 40. The unique feature of containing the envelopes underneath the greeting cards and only accessing them by sliding out the tray 40 when needed allows the improved collating structure 10 of the present invention to limit the overall size of the collating structure to the size of the greeting cards. In other words, there is no need for a overall container size large enough to simultaneously display both components, thus reducing the manufacture costs and material usage of the collating structure and reducing the shipping and display costs for the items. It is noted that reverse order of loading the items to be separately contained outlined above can also be used with the improved collating structure of the present invention.

It is further noted that although the containment of two functionally-related or traditionally-associated items is described herein in detail, the use of the improved collating structure to contain three or more such items, or items merely desired in close proximity, are contemplated herein. For example, the additional hollow space located underneath and towards the second end 150 of the insert 30 of this embodiment of the collating structure 10 could be utilized to separately contain one or more additional items associated with or desired in close proximity to the first two, such as postage stamps in the greeting card/envelopes example outlined above.

Now referring to FIGS. 10–13, a second embodiment of the collating structure of the present is illustrated. In this embodiment of the collating structure, the collating structure 210 is again comprised of a main body portion 220, an insert 230 removably disposed within the main body portion 220, and a pocket 240 slidable between a first position (FIG. 10) and a second position (FIG. 11).

In this embodiment, the main body portion 220 is substantially similar to the embodiment previously described. The main body portion 220 is comprised of a base, a pair of vertical side walls 270, a pair of vertical end walls 260, and a lid 250 (not shown). Like the first embodiment, the lid 250 of the main body portion 220 is foldable to completely cover the top of the main body portion 220. A tab and receiving slot (not shown) or other device to secure the lid 250 is optional. It is noted that any suitable means or device to secure the lid 250 of the main body portion 220 is contemplated by the present invention.

Figure 15:
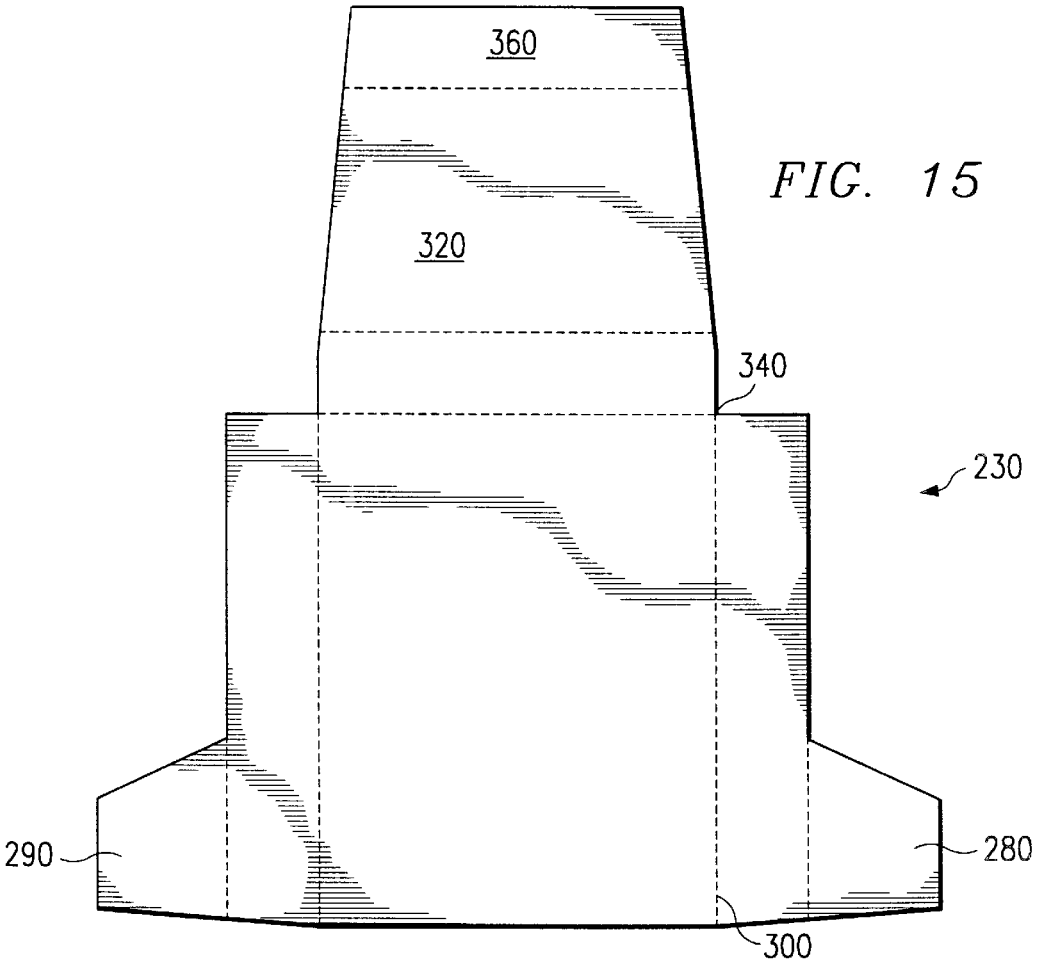
FIG. 15 is a top view of the unfolded insert of a second embodiment of the improved collating structure of the present invention.

The insert 230 of this embodiment of the collating structure 210 is essentially identical to the insert 30 (FIG. 1) of the first embodiment. Now referring to FIG. 12, wherein like elements are identified with like reference numerals, there is shown the insert 230 of the collating structure 210 separated from the main body portion 220. The insert 230 is substantially hollow and, when placed within the main body portion 220, takes up less than the space defined by the vertical side walls 270 and vertical end walls 260 of the main body portion 220, forming a false floor to the collating structure 210. As illustrated in FIG. 13, the insert 230 includes folding flaps 280 and 290 which fold substantially across the width W the underside of the insert 230 towards a first end 300. Unlike the folding flaps 100 and 110 of the first embodiment (FIGS. 7–9), folding flaps 280 and 290 of the second embodiment do not overlap or attach to each other. However, like the first embodiment, when folded, the folding flaps 280 and 290 define a receiving guide 310 for the pocket 240. A large end flap 320 located at a second end 340 of the insert 230 folds across a portion of the length L of the insert 230. The end flap 320 provides support for the upper portion of the insert 230. Located at terminating end of the end flap 320 is a hinged flap 360, which folds upwards to form a vertical wall against which the end of the pocket 240 will rest, when resting within the insert 230. The vertical wall formed by the hinged flap 360 provides an important structural role in that it prevents the pocket 240 from sliding too far into the hollow space defined by the insert 230. In FIG. 15, where like elements are designated with like reference numerals, a bottom view of an unfolded insert 230 is illustrated.

Now referring again to FIG. 13, the pocket 240 is comprised of a base panel 380, a vertical sectioning panel 400, a partial top panel 410, an end panel 420 and a tab 430 located at the terminating end of the end panel 420. Although the pocket 240 of the collating structure 210 lacks side walls, it defines a second compartment which is substantially larger than the second compartment of the first embodiment described above. The tab 430 of the pocket 240 facilitates sliding of the pocket 240 between a first position (disposed entirely within the insert 230—FIG. 10), a second position (extending out and away from the insert 230—FIG. 11) and a third position (separated from the insert 230—FIG. 13). When the pocket 240 is in the first position (FIG. 10), it is substantially hidden underneath the insert 230. Accordingly, items contained within the pocket 240 are not visible when the open collating structure 210 is viewed. When the contents of the pocket 240 are desired, the tab 430 is pulled and the pocket 240 slides out of the insert 230, extending out and above the main body portion 220 of the collating structure 210. In this second position (FIG. 11), the contents of the pocket 240 are easily viewed and extracted.

In the third position (FIG. 13), the pocket 240 is completely separated from the insert 230. In this position, the pocket 240 is most easily load with items to be contained in the second compartment. When the contents of the second compartment defined by the pocket 240 are loaded, the pocket 240 is reinserted underneath the insert 230 and the tab 430 is gently pushed back towards the main body portion 230, sliding the pocket 240 underneath the insert 230 and out of sight. Due to the relatively large size of the pocket 240, this embodiment is ideally suited for the containment of larger items.

As noted above with respect to the first embodiment, although the containment of functionally-related or traditionally-associated items is described herein, the improved collating structure of the present invention may be used to receive, store, ship, display and withdraw any number of items which are desired in close proximity to each other.

Although preferred embodiments of the invention have been illustrated in the accompanying drawings and described in the foregoing Detailed Description, it will be understood that the invention is not limited to the embodiments disclosed, but is capable of numerous rearrangements and modifications of parts and elements without departing from the spirit of the invention.

I claim:

1. An improved collating structure adapted for receipt, storage, withdrawal and reinsertion of at least two different items, comprising:

a main body portion;

an insert removably disposed within the main body portion and defining a first compartment capable of containing items within the collating structure;

said insert further including a receiving guide providing access to a hollow portion defined underneath the insert;

a tray slidable between a first position and a second position;

said first tray including a recessed portion defining a second compartment capable of containing items within the collating structure;

said tray when in the first position being disposed underneath and within the hollow portion of the insert; and said tray when in the second position extending outward and slightly above the insert, providing visual and actual access to the second compartment for the insertion or removal of items.

2. The collating structure of claim 1, wherein the main body portion comprises a base, a pair of vertical side walls, a pair of vertical end walls and a foldable lid.

3. The collating structure of claim 1, wherein foldable flaps associated with the insert define a substantially hollow portion underneath the insert.

4. The collating structure of claim 3, wherein the hollow portion of the insert is accessible through a receiving guide defined by a first end of the foldable flaps of the insert.

5. The collating structure of claim 4, wherein the foldable flaps include a tab and a receiving slot to secure the flaps together.

6. The collating structure of claim 1, wherein the first compartment is formed above the insert and below the lid of the main body portion of the collating structure when the lid is in a closed position.

7. The collating structure of claim 1, wherein the tray includes a tab extending therefrom, facilitating sliding of the tray between the first position and the second position.

8. The collating structure of claim 1, wherein the insert includes a second substantially hollow portion underneath and within it for containing additional items.

9. The collating structure of claim 1, wherein the items contained within the first compartment and the second compartment are functionally-related or traditionally associated items.

10. The collating structure of claim 1, wherein the tray further includes at least one elongated tab which guides the sliding of the tray between the first position and the second position.

11. The collating structure of claim 1, wherein the insert is supported by at least one tab extending therefrom and contacting the main body portion.

12. An improved collating structure adapted for the receipt, storage, withdrawal and reinsertion of at least two different items, comprising:

a main body portion;

an insert removably disposed within the main body portion and defining a first compartment capable of containing items within the collating structure;

a pocket slidable between a first position and a second position;

said pocket defining a second compartment capable of separately containing items;

said pocket when in the first position being disposed underneath the insert; and said pocket when in the second position extending outward and slightly above the insert, providing visual and actual access to items contained therein.

13. The collating structure of claim 12, wherein the main body portion comprises a base, a pair of vertical side walls, a pair of vertical end walls and a foldable lid.

14. The collating structure of claim 12, wherein the first compartment is formed above the insert and below the lid of the main body portion of the collating structure when the lid is in a closed position.

15. The collating structure of claim 12, wherein the pocket includes a tab extending therefrom, facilitating sliding of the pocket between the first position and the second position.

16. The collating structure of claim 12, wherein the insert includes a substantially hollow portion underneath and within it for containing additional items.

17. The collating structure of claim 12, wherein the items contained within the first compartment and the second compartment are functionally-related or traditionally associated items.

18. An improved collating structure of the type in which a first compartment and a second compartment are included within an open box for the separate storing and displaying of at least two items and from which such items can be selectively withdrawn, wherein the improvement comprises:

a first compartment slidable between a first position and a second position;

said first compartment capable of separately containing items;

said first compartment when in the first position being disposed underneath a second compartment; and said compartment when in the second position extending outward and slightly above the second compartment, providing visual and actual access to items contained therein.

19. The improved collating structure of claim 18, wherein the first compartment is tilted upwards at its end when it is moved from the first position towards the second position, slightly skewing and separating items contained within the first compartment to facilitate viewing and selective withdrawal of said items.

* * * * *